US011400341B2

(12) United States Patent
Van Willigen et al.

(10) Patent No.: US 11,400,341 B2
(45) Date of Patent: Aug. 2, 2022

(54) HAND GRIP EXERCISER

(71) Applicant: Everlast Worldwide, New York, NY (US)

(72) Inventors: Daniel Van Willigen, Yonkers, NY (US); Tori Hart, Brooklyn, NY (US)

(73) Assignee: EVERLAST WORLDWIDE, INC., New York, NY (US)

( * ) Notice: Subject to any disclaimer, the term of this patent is extended or adjusted under 35 U.S.C. 154(b) by 0 days.

(21) Appl. No.: 17/036,917

(22) Filed: Sep. 29, 2020

(65) Prior Publication Data

US 2022/0072369 A1 Mar. 10, 2022

Related U.S. Application Data

(63) Continuation-in-part of application No. 29/749,464, filed on Sep. 4, 2020.

(51) Int. Cl.
*A63B 23/16* (2006.01)
*A63B 21/02* (2006.01)
(Continued)

(52) U.S. Cl.
CPC ..... *A63B 23/16* (2013.01); *A63B 21/00069* (2013.01); *A63B 21/023* (2013.01); *A63B 21/028* (2013.01); *A63B 21/0428* (2013.01)

(58) Field of Classification Search
CPC ..... A63B 21/0004; A63B 21/00043; A63B 21/28; A63B 21/40; A63B 21/4017;
(Continued)

(56) References Cited

U.S. PATENT DOCUMENTS 4,753,434 A * 6/1988 Salvino ..... A63B 23/16 482/121
6,786,849 B1 * 9/2004 Faulconer ..... A63B 23/16 482/121
(Continued)

FOREIGN PATENT DOCUMENTS

CN 208003368 U 10/2018
CN 209237267 U 8/2019
(Continued)

OTHER PUBLICATIONS

Search Report prepared in corresponding application GB2019385.0 dated May 10, 2021.

*Primary Examiner* — Megan Anderson
*Assistant Examiner* — Thao N Do
(74) *Attorney, Agent, or Firm* — Howard M. Gitten, Esq.; Lewis Brisbois Bisgaard & Smith LLP

(57) ABSTRACT

A handgrip exerciser device has two pivotally interconnected arms. Each arm has a first end region, a central region and a second end region. Each arm has at its first end region a hand grip. The central region forms a pivot pin receiving area. A pivot pin extends between the two arms enabling the arms to be rotatably connected together. Each arm having at its second end region a mounting portion. A resistance element providing a resistive force against rotational movement of the arms and having first and second ends. A first arm mounting portion supports the first end of the resistance element providing element. A second arm mounting portion supports the second end of the resistance element. An adjustment element adjusts the resistive force applied by the resistance element to the rotation of the two arms around the pivot pin.

8 Claims, 3 Drawing Sheets

(51) Int. Cl.
*A63B 21/00* (2006.01)
*A63B 21/04* (2006.01)

(58) Field of Classification Search
CPC ..... A63B 21/4019; A63B 21/4021; A63B 21/4023; A63B 21/4033; A63B 21/4035; A63B 21/4039; A63B 22/00; A63B 22/0002; A63B 22/0005; A63B 22/0025; A63B 2022/0041; A63B 2022/0035; A63B 2022/185; A63B 23/00; A63B 23/035; A63B 23/03508; A63B 23/03516; A63B 23/03525; A63B 23/0355; A63B 23/03558; A63B 23/03566; A63B 23/12; A63B 23/14; A63B 23/16
USPC ..... 482/49
See application file for complete search history.

(56) References Cited

U.S. PATENT DOCUMENTS 7,824,311 B1 * 11/2010 Hsu ..... A63B 23/16 482/126
8,915,824 B2 * 12/2014 Roberts ..... A63B 21/0004 482/68
8,926,477 B2 * 1/2015 Lynn ..... A63B 23/16 482/49
8,944,942 B2 * 2/2015 Oravecz ..... A63B 21/4043 473/518
9,028,378 B2 * 5/2015 Shah ..... G05G 1/10 482/109
9,352,183 B2 * 5/2016 Quinn ..... A63B 21/0421
9,415,262 B2 * 8/2016 An ..... A63B 21/023
9,474,931 B2 * 10/2016 Alldredge ..... A63B 21/4035
9,694,237 B2 * 7/2017 Palmenco-Geller ..... A63B 21/065
9,700,749 B2 * 7/2017 Carpinelli ..... A63B 21/00072
10,143,886 B2 * 12/2018 Carpinelli ..... A63B 21/025
10,188,904 B2 * 1/2019 Tam ..... A63B 71/0036
10,220,283 B2 * 3/2019 Rosberger ..... A63B 69/02
10,388,180 B1 * 8/2019 Dayan ..... G09B 15/06
10,449,406 B2 * 10/2019 Alnajjar ..... A63B 21/4035
10,672,291 B2 * 6/2020 Raimondi ..... G09B 15/06
10,688,340 B1 * 6/2020 Aldredge ..... A63B 21/0421
10,821,317 B2 * 11/2020 Ellis ..... G08B 25/016
10,881,902 B2 * 1/2021 Shiao ..... A63B 1/00
10,898,749 B2 * 1/2021 Ju ..... A63B 23/16
10,974,098 B2 * 4/2021 Zerbo ..... A63B 21/4019
10,981,027 B2 * 4/2021 Reda ..... A63B 21/023
11,052,283 B2 * 7/2021 An ..... A63B 23/16
2004/0003687 A1 1/2004 An
2016/0235613 A1 * 8/2016 Waldman ..... A63B 23/16
2018/0169458 A1 * 6/2018 Hao ..... A63B 21/00065
2019/0255383 A1 * 8/2019 An ..... A63B 21/023

FOREIGN PATENT DOCUMENTS

CN 209933979 U 1/2020
CN 211357625 U 8/2020
KR 101999851 B1 10/2019

* cited by examiner 3b
3a 3b
12b
22
2b
12a

HAND GRIP EXERCISER

CROSS REFERENCE TO RELATED APPLICATIONS

This application claims the benefit of U.S. Provisional application Ser. No. 29/749,464 filed on Sep. 4, 2020. The entire contents of this application is incorporated herein by reference in its entirety.

BACKGROUND

The present invention relates to a hand grip exerciser device, in particular to improvements to enable any resistive force to be easily adjusted Hand grip exercisers are known and used to improve the strength of hand grips and wrists. Frequently such devices are small hand held devices having two handles and in which a user squeezes the handles together against a resistive force and releases the handles gently so the device returns to a rest position.

Known devices can be in the form of a single coiled spring with handles extending from the ends of the coiled spring. These are examples of a simple device and only one resistive force is provided, so a plurality of exercisers are needed to provide a wide range of exercises. Other devices are known in which a pair of arms are pivotally connected together and the force required to squeeze the handles together can be changed by varying the spring itself, so requiring a plurality of springs to provide a range of exercises. alternatively, it is known to provide a range of adjustment positions so that the resistance providing spring has a variety of positions on the handles. Sometimes such adjustments are made by varying the positions of the pins in the handles, and the pins are moveable between a plurality of holes.

The present invention seeks to overcome at least some of the disadvantages of the prior art by providing an easily used adjustment means that enables the resistive force provided to be adjusted smoothly and easily.

SUMMARY OF THE INVENTION

According to the present invention there is provided a handgrip exercising device comprising: two pivotally interconnected arms; each arm having a first end region, a central region and a second end region; each arm having at its first end region a hand grip, a central region comprising a pivot pin receiving area, a pivot pin extending between the two arms to enable the two arms to be rotatably connected together, each arm having at its second end region a mounting portion; a resistance providing element providing a resistive force against rotational movement of the arms and having first and second ends, a first mounting portion of the first arm including means to support the first end of the resistance providing element, a second mounting portion of the second arm including means to support the second end of the resistance providing element and adjustment means to adjust the resistive force applied by the resistance providing element to the rotation of the two arms around the pivot pin.

According to a further aspect of the present invention there is provided an exercising device, the adjustment means further comprising a threaded screw having a longitudinal axis around which it rotates, the screw attached at a first end to the resistance providing element and engaging a threaded nut mounted on the second mounting portion of the second arm and the screw having at a second end a means to facilitate its rotation, the screw rotatable about its longitudinal axis to move along it in relation to the threaded nut, so changing the length of the resistance providing element.

According to a yet further aspect of the present invention there is provided an exercising device in which the resistance providing element has a longitudinal axis which is parallel to the longitudinal axis of the screw.

According to a yet further aspect of the present invention there is provided an exercising device in which in which the resistance providing element has a longitudinal axis which is co-axial to the longitudinal axis of the screw.

According to a yet further aspect of the present invention there is provided a device in which the resistance providing means is a helical coil spring.

According to a yet further aspect of the present invention there is provided an exercising device in which the resistance providing means is an elastomeric compound.

According to a yet further aspect of the present invention there is provided an exercising device in which the resistance providing means is a resistance means is a rubber based compound.

BRIEF DESCRIPTION OF THE DRAWINGS

The present disclosure will be better understood by reading the written description with reference to the accompanying drawing figures in which like reference numerals denote similar structure and refer to like elements throughout in which.

Figure 1:
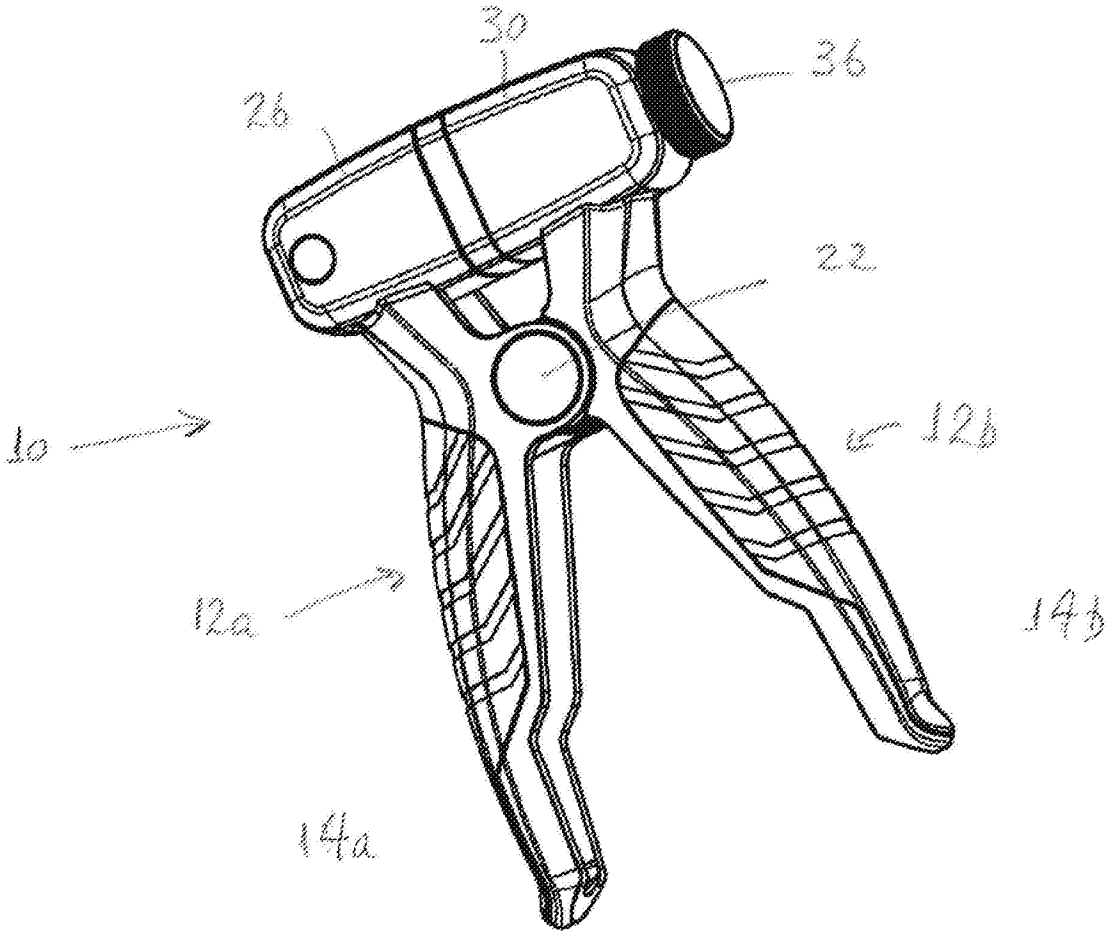
FIG. 1 is a perspective view of a hand grip exerciser according to the present invention.
Figures 2A, 2B, 2C, 2D:
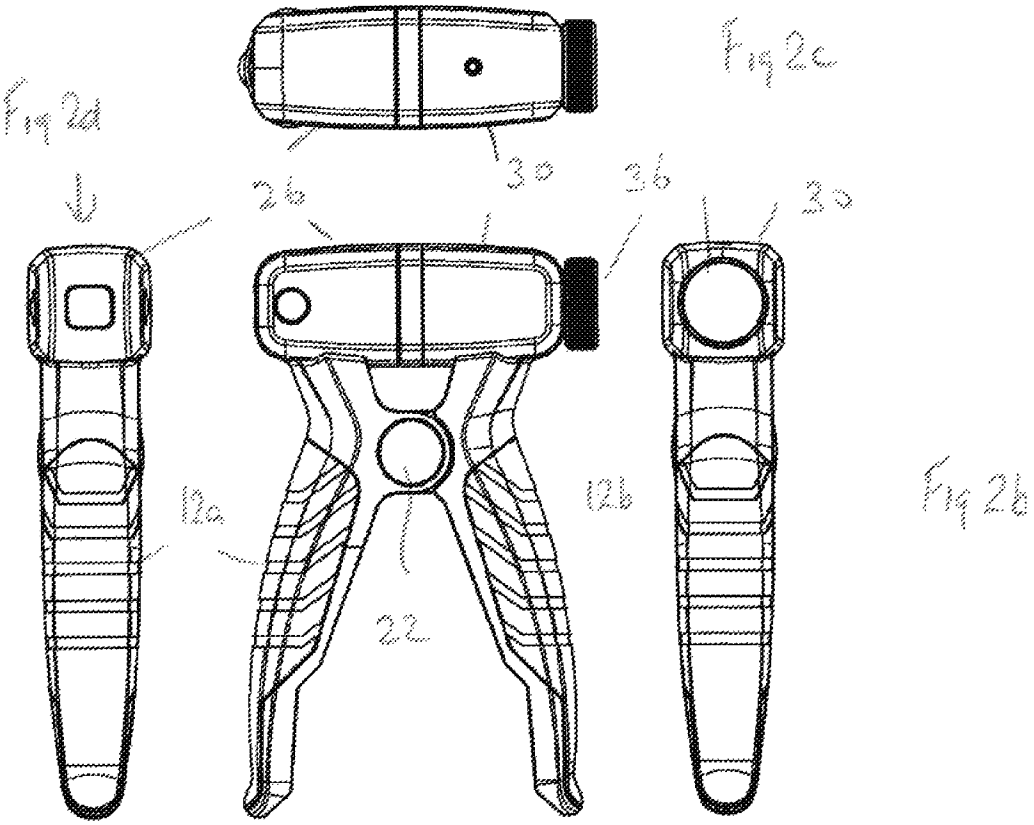
FIGS. 2*a*-2*d* is a side elevation view, front elevation view, rear elevation view and top plan view respectively of the exerciser.

While various embodiments are amenable to various modifications and alternative forms, specifics thereof have been shown by way of example in the drawings and will be described in detail. It should be understood, however that the intention is not to limit the claimed inventions to the particular embodiments described. On the contrary, the intention is to cover all modifications, equivalents and alternatives falling within the spirit and scope of the subject matter as defined by the claims.

DETAILED DESCRIPTION OF THE EMBODIMENTS

The invention will now be described in more detail with reference to the drawings.

Reference is now made to FIG. 1 which shows a perspective view of the exerciser 10, constructed in accordance with a preferred embodiment of the invention, in its normal state. The exerciser 10 includes two handgrips 12*a* and 12*b* forming respective arms. At a first end of each of the handgrips 12*a*, 12*b* are respective handle parts 14*a*, 14*b*. The handgrips are connected together in a central region. Bearing covering plates 22 (only one of which can be seen in this figure) cover a pivot pin. At second end of each of handgrips 12*a*, 12*b*, remote from the handle parts 14*a*, 14*b* are respective mounting heads 26, 30. The exerciser 10 includes resistance providing structure (not shown in these figures) to provide a resistive force against which the user will exercise by squeezing the handle parts 14*a*, 14*b* together. On mounting head 30 an adjustment assembly is provided to enable easy adjustment of the resistance of exerciser 10 as will be described in more detail below.

FIGS. 2*a*-2*d* show side, front, and rear elevation views and a top plan view of the exerciser 10. Arms 12*a* and 12*b* are interconnected by a pivot covered by covering plate 22. The resistive structure is mounted in the mounting head portions 26, 30 as will be explained in more detail below. The adjustment assembly is provided on the mounting head 30 to enable easy adjustment of the resistive force applied by the resistance element.

Figure 3:
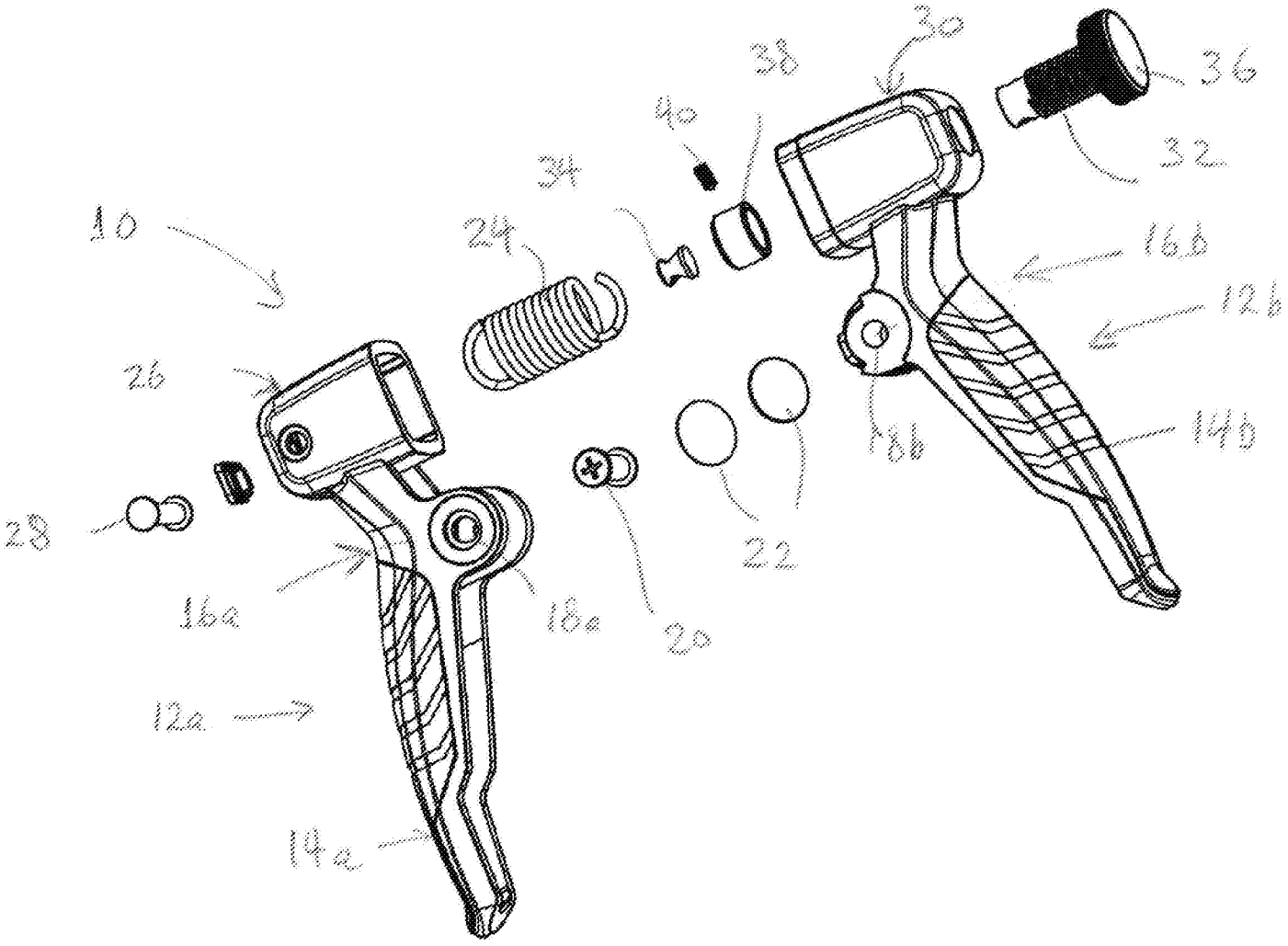
FIG. 3 shows an expanded view of the exerciser.

FIG. 3 shows an exploded view of the exerciser 10. Pivotally connected arms 12*a*, 12*b* each have respective handgrip regions formed on handle parts 14*a*, 14*b* located at a respective first end of the arms 12*a*, 12*b*. Each of arms 12*a*, 12*b* extends to respective central regions 16*a*, 16*b* which in turn extend to and support respective bearing surfaces 18*a*, 18*b*. The bearing surfaces 18*a*, 18*b* surround a mounting hole, formed through each of bearing surfaces 18*a*, 18*b*, through which a pivot pin 20 passes. The bearing surfaces 18*a* and 18*b* engage with each other and are adapted to allow the arms 12*a*, 12*b* to be pivotally interconnected by pin 20 passing through bearing surfaces 18*a*, 18*b*. Arms 12*a*, 12*b* rotate about an axis defined by a longitudinal axis of the pin 20. The pin 20 and bearing surfaces 18*a*, 18*b* are covered by covering plates 22 to assist in protecting the pin 20 and bearing surfaces 18*a*, 18*b* from damage and the ingress of unwanted materials.

At a second end of each of the arms 12*a*, 12*b* remote from the handgrip region are mounting means for mounting the resistive element 24. The first arm 12*a* includes a first mounting head 26. The mounting head 26 supports a securing pin 28, which in turn provides a mounting part for securing a first end of the resistance element 24. In this embodiment, the resistive element 24 is a helical coil spring, having a first end of the coil formed into a loop shape which engages with the securing pin 28 to hold the spring in place in the mounting head 26. The second arm 12*b* includes a second mounting head 30 for mounting a second end of the spring 24. Mounting head 30 includes an adjustment assembly. The adjustment assembly includes a threaded screw 32 having a longitudinal axis about which the screw rotates in known manner and a head end 36 which is formed to make it easy to rotate the screw 32. Such a head end 36 may be formed with a grip surface such as a knurled edge or circumference, as is well known in the art or other convenient form of grip.

The screw 32 engages with a threaded nut 38, secured in the mounting head 30 against rotation with the screw, along a longitudinal axis of threaded nut 38. In the present embodiment the threaded nut 38 is secured in the mounting head 30 by one or more pins 40. A second end of the screw 32 includes a rotatable coupling element 34, a first part of which is attachable to the resistive element 24 and a second part which is rotatably connected to the screw 32, so enabling the screw 32 to rotate without also causing the resistive element 24 to be rotated at the same rate as the screw 32. By this structure the screw 32 can be rotated around its longitudinal axis and so move along the longitudinal axis to change the position of the screw 32 in the threaded nut 38 and so also change the length of the resistive element 24 without rotating it resistive element 24. Rotating the screw 32 will move screw 32 along its longitudinal axis relative to nut 38 and so change the length of the spring 24, and, as a result, increasing or decreasing the resistive force applied against rotation of the handles around the pivot point. From this is it can be seen that the resistive force applied by the spring to any movement of the handle parts 14*a*, 14*b* around the pivot pin 20 can be easily adjusted. An additional advantage of the present embodiment is the adjustment can be done in fine, if not infinitesimally fine steps.

Alternatively, the spring 24 could be replaced by an elastomeric element, such as a rubber or synthetic compound, provided with anchoring points at each end. at a first end, the anchoring point could be secured to an alternative form of securing pin 28. At a second end, the elastomeric element could be secured to the resistance attachment means by a rotatable coupling similar to that described above.

While specific embodiments have been described in detail in the foregoing detailed description and illustrated in the accompanying drawings, those with ordinary skill in the art will appreciate that various modifications and alternatives to those details could be developed in light of the overall teaching of the disclosure. Accordingly, the particular arrangements disclosed are meant to be illustrative only and not limiting as to the scope of the invention, which is to be given the full breadth of the appended claims in any and all equivalents thereof.

The invention claimed is:

1. A handgrip exercising device comprising:

a first arm;

a second arm pivotally connected to the first arm; each of the first and second arms having a first end region, a central region and a second end region; each of the first and second arms having a hand grip formed at the respective first end region, a pivot pin extending between the first arm and the second arm at the central region to enable the first arm and the second arm to be rotatably connected together, each of the first and second arms having at the respective second end region a mounting head;

a resistance element providing a resistive force against rotational movement of the first arm and the second arm relative to each other, the resistance element having a first end and second end, a first mounting portion formed on the first arm including a support structure securing the first end of the resistance element to the first mounting portion, a second mounting portion formed on the second arm including a second support structure operatively coupled to the second end of the resistance element to support the second end of the resistance element; and an adjustment assembly operatively coupled to the second support structure to adjust the resistive force applied by the resistance element to the rotation of the first arm and the second arm relative to each other about the pivot pin, a threaded nut disposed within the second mounting portion, the adjustment assembly further comprising a threaded screw having a longitudinal axis around which the threaded screw rotates, the threaded screw being attached at a first end to the resistance element and engaging the threaded nut; the threaded screw having at a second end, a head end configured to facilitate rotation of the threaded screw, the threaded screw being rotatable about the longitudinal axis to move along the longitudinal axis in relation to the threaded nut, so changing a length of the resistance element; and wherein the resistance element has a longitudinal axis which is parallel to the longitudinal axis of the threaded screw.

2. The exercising device according to claim 1, wherein the resistance element is a helical coil spring.

3. The exercising device according to claim 1, wherein the resistance element is an elastomeric compound.

4. The exercising device according to claim 1, wherein the resistance element is a rubber based compound.

5. A handgrip exercising device comprising:

a first arm;

a second arm pivotally connected to the first arm; each of the first and second arms having a first end region, a central region and a second end region; each of the first and second arms having a hand grip formed at the respective first end region, a pivot pin extending between the first arm and the second arm at the central region to enable the first arm and the second arm to be rotatably connected together, each of the first and second arms having at the respective second end region a mounting head;

a resistance element providing a resistive force against rotational movement of the first arm and the second arm relative to each other, the resistance element having a first end and second end, a first mounting portion formed on the first arm including a support structure securing the first end of the resistance element to the first mounting portion, a second mounting portion formed on the second arm including a second support structure operatively coupled to the second end of the resistance element to support the second end of the resistance element; and an adjustment assembly operatively coupled to the second support structure to adjust the resistive force applied by the resistance element to the rotation of the first arm and the second arm relative to each other about the pivot pin, a threaded nut disposed within the second mounting portion, the adjustment assembly further comprising a threaded screw having a longitudinal axis around which the threaded screw rotates, the threaded screw being attached at a first end to the resistance element and engaging the threaded nut; the threaded screw having at a second end, a head end configured to facilitate rotation of the threaded screw, the threaded screw being rotatable about the longitudinal axis to move along the longitudinal axis in relation to the threaded nut, so changing a length of the resistance element; and wherein the resistance element has a longitudinal axis which is co-axial to the longitudinal axis of the threaded screw.

6. The exercising device according to claim 5, wherein the resistance element is a helical coil spring.

7. The exercising device according to claim 5, wherein the resistance element is an elastomeric compound.

8. The exercising device according to claim 5, wherein the resistance element is a rubber based compound.

* * * * *